US008245622B2

(12) United States Patent
Farinella et al.

(10) Patent No.: US 8,245,622 B2
(45) **Date of Patent: *Aug. 21, 2012**

(54) VEHICLE AND STRUCTURE SHIELD METHOD

(75) Inventors: Michael D. Farinella, Belmont, MA (US); Robert Lee Cardenas, Framingham, MA (US); William R. Lawson, Gloucester, MA (US); Brendan LaBrecque, Peabody, MA (US); Frances Rush, Norwood, MA (US); David Hoadley, Lexington, MA (US); Michael Wheaton, Charlestown, MA (US); Michael Anderson, Lowell, MA (US); Thomas Mann, Littleton, MA (US); Abed Kanaan, Still River, MA (US); Patrick Callahan, Maynard, MA (US)

(73) Assignee: QinetiQ North America, Inc., McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/136,284

(22) Filed: Jul. 27, 2011

(65) Prior Publication Data

US 2012/0180639 A1 Jul. 19, 2012

Related U.S. Application Data

(62) Division of application No. 12/386,114, filed on Apr. 14, 2009, now Pat. No. 8,011,285.

(60) Provisional application No. 61/124,428, filed on Apr. 16, 2008.

(51) Int. Cl.
*F41H 11/00* (2006.01)
*F41H 13/00* (2006.01)

(52) U.S. Cl. ..... 89/36.08; 89/36.02; 89/36.07; 89/36.09; 89/918

(58) Field of Classification Search ..... 89/36.01–36.17; 109/49.5; 114/241; 296/187.07
See application file for complete search history.

(56) References Cited

U.S. PATENT DOCUMENTS

| | | | | |
|---|---|---|---|---|
| 1,198,035 A | | 9/1916 | Huntington | |
| 1,229,421 A | | 6/1917 | Downs | |
| 1,235,076 A | | 7/1917 | Stanton | |
| 1,274,624 A | * | 8/1918 | Steinmetz | 102/409 |
| 1,367,249 A | * | 2/1921 | Goodyear | 403/207 |

(Continued)

FOREIGN PATENT DOCUMENTS

DE 691067 5/1940

(Continued)

OTHER PUBLICATIONS

U.S. Appl. No. 13/136,283, Farinella et al.

(Continued)

*Primary Examiner* — Michael Carone
*Assistant Examiner* — Joshua Freeman
(74) *Attorney, Agent, or Firm* — Iandiorio, Teska & Coleman LLP

(57) ABSTRACT

A vehicle and structure shield includes a flexible net subsystem including an array of rods or hard points supported by the net subsystem and configured to impact a projectile striking the net. A frame includes mounting brackets attached thereto positioning the frame in a spaced relationship with respect to the vehicle or structure. A first releasable fastener subsystem releasably secures the net subsystem to the frame and a second releasable fastener subsystem releasably secures the mounting brackets of the frame to a vehicle or structure.

6 Claims, 7 Drawing Sheets

U.S. PATENT DOCUMENTS 1,385,897 A 7/1921 Tresidder
1,552,269 A * 9/1925 Brocker ..... 140/11
2,238,779 A * 4/1941 Mosebach ..... 140/112
2,296,980 A 9/1942 Carmichael
2,308,683 A 1/1943 Forbes
2,322,624 A 6/1943 Forbes
3,608,034 A * 9/1971 Bramley et al. ..... 264/145
3,633,936 A 1/1972 Huber
3,656,790 A 4/1972 Truesdell
3,656,791 A 4/1972 Truesdell
3,733,243 A * 5/1973 Crawford ..... 428/107
3,893,368 A 7/1975 Wales, Jr.
3,950,584 A * 4/1976 Bramley ..... 428/113
3,992,628 A 11/1976 Karney
4,051,763 A * 10/1977 Thomanek ..... 89/36.17
4,157,411 A * 6/1979 Thomson ..... 428/107
4,253,132 A 2/1981 Cover
4,262,595 A 4/1981 Longerich
4,358,984 A 11/1982 Winblad
4,399,430 A 8/1983 Kitchen
4,411,462 A 10/1983 Buehrig et al.
4,688,024 A 8/1987 Gadde
4,768,417 A 9/1988 Wright
4,912,869 A 4/1990 Govett
4,928,575 A 5/1990 Smirlock et al.
4,950,198 A 8/1990 Repko, Jr.
5,007,326 A 4/1991 Gooch, Jr. et al.
5,025,707 A 6/1991 Gonzalez
5,069,109 A 12/1991 Lavan, Jr.
5,078,117 A 1/1992 Cover
5,094,170 A 3/1992 Raynaud et al.
5,170,690 A 12/1992 Smirlock et al.
5,191,166 A 3/1993 Smirlock et al.
5,279,199 A 1/1994 August
5,291,715 A * 3/1994 Basile ..... 52/687
5,333,532 A 8/1994 Smirlock et al.
5,342,021 A 8/1994 Watson
5,370,035 A 12/1994 Madden, Jr.
5,394,786 A 3/1995 Gettle et al.
5,400,688 A 3/1995 Eninger et al.
5,435,226 A 7/1995 McQuilkin
5,441,239 A 8/1995 Watson
5,524,524 A * 6/1996 Richards et al. ..... 89/1.13
5,578,784 A 11/1996 Karr et al.
5,583,311 A 12/1996 Rieger
5,609,528 A 3/1997 Kehoe
5,622,455 A 4/1997 Anderson et al.
5,646,613 A 7/1997 Cho
5,705,058 A 1/1998 Fischer
5,725,265 A 3/1998 Baber
5,739,458 A 4/1998 Girard
5,750,918 A 5/1998 Mangolds et al.
5,792,976 A 8/1998 Genovese
5,898,125 A 4/1999 Mangolds et al.
5,924,723 A 7/1999 Brantman et al.
5,988,036 A 11/1999 Mangolds et al.
6,029,558 A 2/2000 Stevens et al.
6,119,574 A 9/2000 Burky et al.
6,128,999 A 10/2000 Sepp et al.
6,279,449 B1 8/2001 Ladika et al.
6,282,860 B1 * 9/2001 Ramirez ..... 52/677
6,311,605 B1 * 11/2001 Kellner et al. ..... 89/36.02
6,325,015 B1 12/2001 Garcia et al.
6,374,565 B1 4/2002 Warren
6,375,251 B1 4/2002 Taghaddos
6,394,016 B2 5/2002 Swartout et al.
6,499,796 B1 12/2002 Eenhoorn
6,595,102 B2 7/2003 Stevens et al.
6,626,077 B1 9/2003 Gilbert
6,672,220 B2 1/2004 Brooks et al.
6,782,792 B1 8/2004 Edberg et al.
6,805,035 B2 10/2004 Edberg et al.
6,854,374 B1 2/2005 Breazeale
6,901,839 B2 6/2005 Edberg et al.
6,904,838 B1 6/2005 Dindl
6,925,771 B2 8/2005 Lee et al.
6,957,602 B1 10/2005 Koenig et al.
7,177,518 B2 2/2007 Chun
7,190,304 B1 3/2007 Carlson
7,244,199 B1 7/2007 Romano
7,308,738 B2 12/2007 Barvosa-Carter et al.
7,328,644 B2 2/2008 Vickroy
7,412,916 B2 8/2008 Lloyd
7,415,917 B2 * 8/2008 Lloyd ..... 102/473
7,513,186 B2 4/2009 Ravid et al.
7,866,248 B2 * 1/2011 Moore et al. ..... 89/36.02
7,866,250 B2 1/2011 Farinella et al.
8,011,285 B2 9/2011 Farinella et al.
2001/0032577 A1 10/2001 Swartout et al.
2001/0048102 A1 12/2001 Telles
2002/0134365 A1 9/2002 Gray
2003/0217502 A1 11/2003 Hansen
2004/0016846 A1 1/2004 Blackwell-Thompson et al.
2005/0011396 A1 1/2005 Burdette et al.
2005/0016372 A1 * 1/2005 Kilvert ..... 89/1.34
2005/0278098 A1 12/2005 Breed
2006/0065111 A1 3/2006 Henry
2006/0112817 A1 * 6/2006 Lloyd ..... 89/1.11
2007/0057495 A1 3/2007 Tesch et al.
2007/0089597 A1 4/2007 Ma
2007/0180983 A1 * 8/2007 Farinella et al. ..... 89/36.07
2008/0164379 A1 * 7/2008 Wartmann et al. ..... 245/8
2008/0258063 A1 10/2008 Rapanotti
2009/0084284 A1 4/2009 Martinez et al.
2009/0104422 A1 4/2009 Sampson
2009/0173250 A1 7/2009 Marscher et al.
2009/0178597 A1 7/2009 Sliwa, Jr.
2009/0217811 A1 * 9/2009 Leeming ..... 89/36.02
2009/0266226 A1 * 10/2009 Beach et al. ..... 89/36.02
2009/0308238 A1 * 12/2009 Schwartz ..... 89/36.02
2010/0282935 A1 11/2010 Zannoni
2010/0288114 A1 11/2010 Soukos
2010/0294124 A1 * 11/2010 Wentzel ..... 89/36.02
2010/0307328 A1 * 12/2010 Hoadley et al. ..... 89/36.02
2011/0067561 A1 * 3/2011 Joynt ..... 89/36.02
2011/0079135 A1 4/2011 Farinella et al.
2011/0136087 A1 6/2011 Corridon
2011/0179944 A1 7/2011 Farinella et al.
2011/0185614 A1 8/2011 Laney et al.
2011/0203453 A1 8/2011 Farinella et al.
2012/0011993 A1 1/2012 Malone et al.
2012/0046916 A1 2/2012 Farinella et al.

FOREIGN PATENT DOCUMENTS

DE 2206404 8/1973
DE 3722420 1/1989
DE 3735426 5/1989
DE 3834367 4/1990
DE 4437412 9/1995
EP 0655603 5/1995
EP 0872705 10/1998
EP 0902250 3/1999
FR 2695467 3/1994
GB 2449055 4/2009
WO WO 99/30966 6/1999
WO WO 2006/134407 12/2006
WO WO 2006/135432 12/2006
WO WO 2008/079001 7/2008
WO WO 2008/070001 12/2008

OTHER PUBLICATIONS

Written Opinion of the International Searching Authority mailed Jan. 7, 2010 for International Application No. PCT/US2009/002363, 5 pages, unnumbered.
Written Opinion of the International Searching Authority mailed, dated Dec. 23, 2011 for International Application No. PCT/US2011/01462, 6 pages, unnumbered.
File History of U.S. Patent Publication No. 2008/0164379 (through Mar. 1, 2011), 304 pages, unnumbered.

* cited by examiner

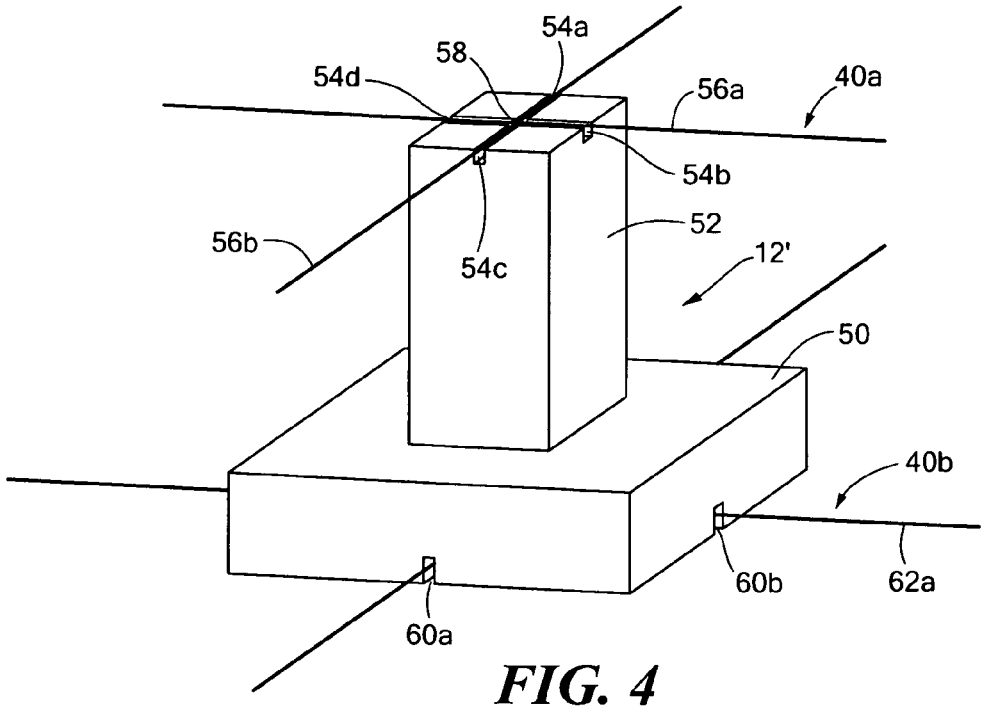
FIG. 4
FIG. 5
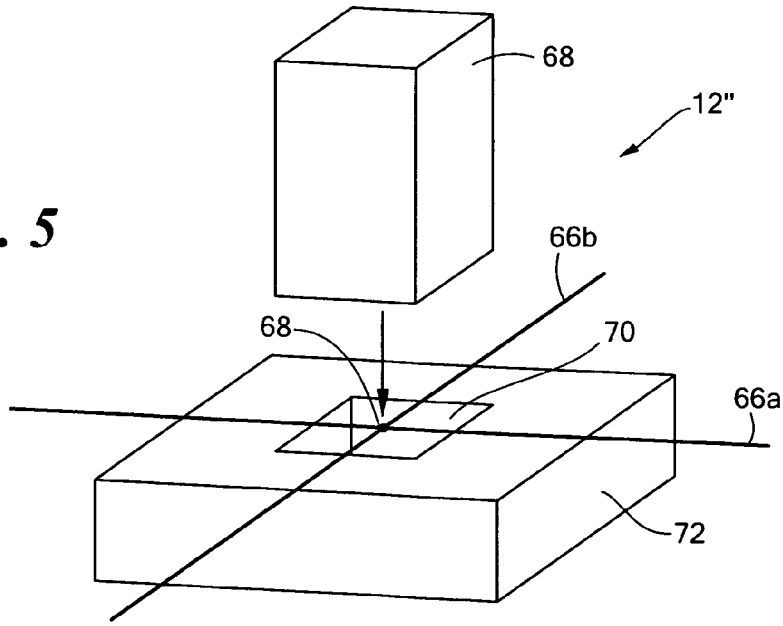

VEHICLE AND STRUCTURE SHIELD METHOD

RELATED APPLICATIONS

This application is a divisional application which claims the benefit of and priority to U.S. patent application Ser. No. 12/386,114, filed on Apr. 14, 2009 now U.S. Pat. No. 8,011,285, which claims the benefit of and priority to U.S. Provisional Application Ser. No. 61/124,428, filed on Apr. 16, 2008 under 35 U.S.C. §§119, 120, 363, 365, and 37 C.F.R. §1.55 and §1.78, each of which is incorporated herein by reference.

FIELD OF THE INVENTION

The subject invention relates to ordinance shielding.

BACKGROUND OF THE INVENTION

Rocket propelled grenades (RPGs) and other ordinance are used by terrorist groups to target military vehicles and structures. See WO 2006/134407 incorporated herein by this reference.

Others skilled in the art have designed intercept vehicles which deploy a net or a structure in the path of an RPG in an attempt to change its trajectory. See U.S. Pat. Nos. 7,190,304; 6,957,602; 5,578,784; and 7,328,644 all incorporated herein by this reference. Related prior art discloses the idea of deploying an airbag (U.S. Pat. No. 6,029,558) or a barrier (U.S. Pat. No. 6,279,499) in the trajectory path of a munition to deflect it. These references are also included herein by this reference.

Many such systems require detection of the RPG and deployment of the intercept vehicle quickly and correctly into the trajectory path of the RPG.

Static armor such as shown in U.S. Pat. Nos. 5,170,690; 5,191,166; 5,333,532; 4,928,575; and WO 2006/134,407 is often heavy and time consuming to install. When a significant amount of weight is added to a HMMWV, for example, it can become difficult to maneuver and top heavy. Such an armor equipped vehicle also burns an excessive amount of fuel.

Moreover, known static systems do not prevent detonation of the RPG. One exception is the steel grille armor of WO 2006/134,407 which is said to destroy and interrupt the electrical energy produced by the piezoelectric crystal in the firing head of the RPG. Bar/slat armor is also designed to dud an RPG. But, bar/slat armor is also very heavy. Often, a vehicle designed to be carried by a specific class of aircraft cannot be carried when outfitted with bar/slat armor. Also, if the bar/slat armor is hit with a strike, the RPG still detonates. Bar/slat armor, if damaged, can block doors, windows, and access hatches of a vehicle.

Chain link fence type shields have also been added to vehicles. The chain link fencing, however, is not sufficiently compliant to prevent detonation of an RPG if it strikes the fencing material. Chain like fencing, although lighter than bar/slat armor, is still fairly heavy. Neither bar/slat armor nor the chain link fence type shield is easy to install and remove.

Despite the technology described in the above prior art, Rocket Propelled Grenades (RPGs) and other threats used by enemy forces and insurgents remain a serious threat to troops on the battlefield, on city streets, and on country roads. RPG weapons are relatively inexpensive and widely available throughout the world. There are varieties of RPG warhead types, but the most prolific are the PG-7 and PG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPGs pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The PG-7 and PG-7M are the most prolific class of warheads, accounting for a reported 90% of the engagements. RPG-18s have been reported as well, accounting for a significant remainder of the threat encounters. Close engagements 30 meters away occur in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and even in churches.

Armor plating on a vehicle does not always protect the occupants in the case of an RPG impact and no known countermeasure has proven effective. Systems designed to intercept and destroy an incoming threat are ineffective and/or expensive, complex, and unreliable.

Pending U.S. patent application Ser. No. 11/351,130 filed Feb. 8, 2006, incorporated herein by this reference, discloses a novel vehicle protection system. The following reflects an enhancement to such a system.

BRIEF SUMMARY OF THE INVENTION

In accordance with one aspect of the subject invention, a new vehicle and structure shield is provided which, in one specific version, is inexpensive, lightweight, easy to install and remove (even in the field), easy to adapt to a variety of platforms, effective, and exhibits a low vehicle signature. Various other embodiments are within the scope of the subject invention.

The subject invention results from the realization, in part, that a new vehicle and structure shield, in one specific example, features a plurality of spaced rods held in position via the nodes of a net and used to dud an RPG or other threat allowing the frame for the net to be lightweight and inexpensive and also easily attached to and removed from a vehicle or structure.

The subject invention features a vehicle and structure shield comprising a flexible net subsystem including an array of rods or hard points supported by the net subsystem and configured to impact a projectile striking the net. A frame including mounting brackets attached thereto positions the frame in a spaced relationship with respect to the vehicle or structure. A first releasable fastener subsystem releasably secures the net subsystem to the frame. A second releasable fastener subsystem releasably secures the mounting brackets of the frame to a vehicle or structure.

In one example, the net subsystem includes first and second spaced nets having nodes interconnected by the rods. In this design, each rod may include a base portion with castellations for the first net and post portion extending from the base portion and also including castellations for the second net.

In another design, the net subsystem includes a single net and the rods each include a post portion and a base portion with a cavity receiving the post portion therein. In one example, the rods include a multi-sided portion defining sharp corners. In one version, there are six sides and six sharp corners. The multi-sided portion may include a cavity frictionally receiving a plug therein and a wall with longitudinal slots therein for the chords of a net.

In one embodiment, the frame may include telescoping members. Typically, the first releasable fastener subsystem includes hook type fasteners on the frame and loop type fasteners on the periphery of the net and the second releasable fastener subsystem includes loop type fasteners on the frame mounting brackets and hook type fasteners on patches securable to the vehicle or structure. The second releasable fastener subsystem may further include straps extending from the frame to the vehicle or structure.

One vehicle and structure shield in accordance with the subject invention includes a net with chords intersecting at nodes and a hard point for at least select nodes. One preferred hard point includes a multi-sided portion defining sharp corners, a cavity therein for a net node, and a plug received in the cavity locking the net node therein. The chords are preferably configured with a compliance which prevents detonation of a munition striking a chord.

One shield system in accordance with the subject invention features a flexible net including chords intersecting at nodes, a hard point for at least select nodes, a frame including mounting brackets positioning the frame in a spaced relationship with a vehicle or structure, a first releasable fastener subsystem releasably securing the net to the frame, and a second releasable fastener subsystem releasably securing the mounting brackets of the frame to the vehicle or structure. The chords of the net are configured with compliance which prevents detonation of an RPG striking a chord.

The subject invention also features a method of protecting a vehicle or structure. One preferred method includes choosing a net mesh size to maximize the effectiveness of the net against the munition striking in the net. Hard points are designed to maximize their effectiveness against a munition striking the net. The hard points are attached to at least select nodes of the net and the net is attached to a frame itself attached to a vehicle or structure supporting the net at a predetermined distance from the vehicle or structure. Attaching the net to the frame and attaching the frame to the vehicle or structure may include using hook and loop fasteners.

The typical net mesh size is between 110 mm and 180 mm. The preferred hard points weight between 10 and 40 grams, are between ½ inch to ¾ inches across, between ½ inch to 1 inch tall, and are multi-sided. The frame is designed to space the net between 4 and 24 inches from the vehicle or structure.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which:

FIG. 4 is a schematic three-dimensional front view showing one example of a hard point rod attached to adjacent nodes of two spaced nets in accordance with the subject invention;

FIG. 5 is a schematic three-dimensional exploded view showing another example of a hard point rod in accordance with the subject invention;

DETAILED DESCRIPTION OF THE INVENTION

Figure 1:
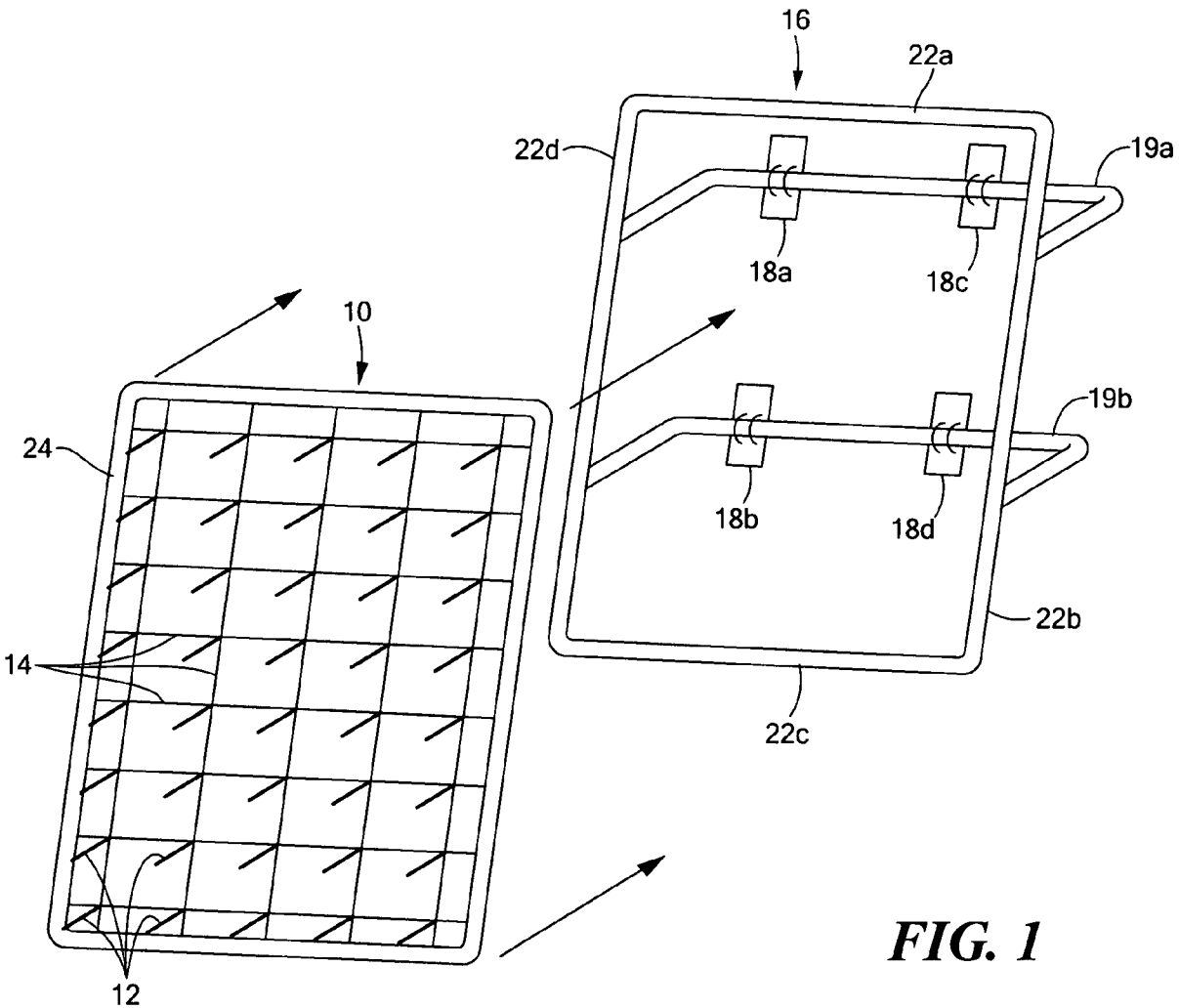
FIG. 1 is a highly schematic three-dimensional exploded view showing an example of one shield protection system in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of flexible net subsystem 10 and including an array of rods 12 configured to impact a projectile (e.g., the nose of an RPG) striking net 14. Frame 16 includes mounting brackets 18*a*-18*d* attached to rearwardly extending members 19*a* and 19*b*. The function of frame 16 and net 14 is to position rods 12 in a spaced relationship with respect to a vehicle or structure and to space the rods 12 apart from each other in an array. When an RPG impacts net 14, rods 12 may angle inwardly towards the nose of the RPG tearing into it and duding the electronics and/or electrical or electronic signals associated with the arming or detonation mechanisms of the RPG. By flexible, we generally mean a net which does not retain its share unless supported in some fashion. When not attached to frame 16, net 14 can be rolled and then folded and/or net 14 can be bunched up.

Figure 2:
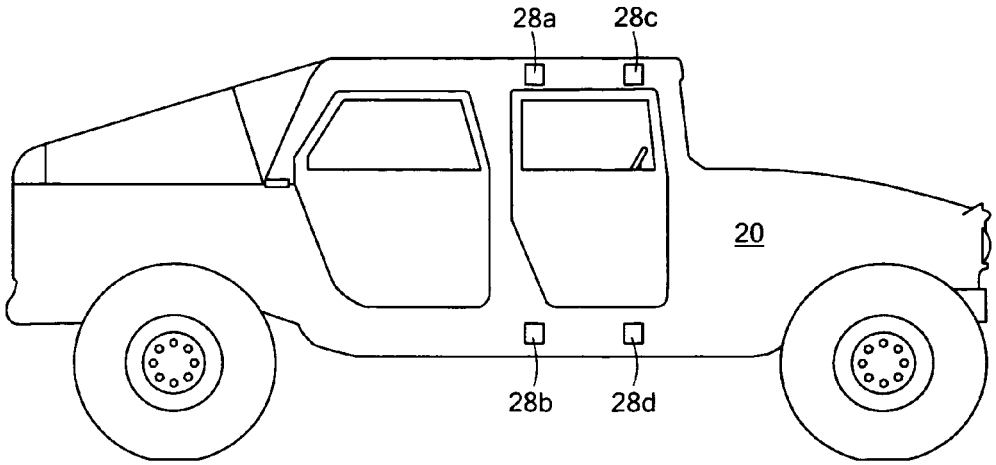
FIG. 2 is a schematic side view of a HMMWV vehicle equipped with hook and loop patches for installation of the shield system shown in FIG. 1.

Preferably, net subsystem 10 is removeably secured to frame 16 and frame 16 is removeably secured to vehicle 20, FIG. 2 (e.g., a HMMWV vehicle). In one particular example, frame members 22*a*-22*d* include hook type fasteners secured to the outside thereof and the net periphery includes loop type fasteners on the inside thereof. Loop type fasteners are also secured to the rear of frame 16 mounting brackets 18*a*-18*d* and corresponding pads or patches 28*a*-28*d*, FIG. 2, adhered to vehicle 20, include outer faces with hook type fasteners. The hook and loop fastening mechanisms, however, may be reversed and other flexible fastener subsystems may also be used. The hook and loop fastening subsystems of U.S. Pat. Nos. 4,928,575; 5,170,690; 5,191,166; and 5,333,532 are preferred.

Figure 3:
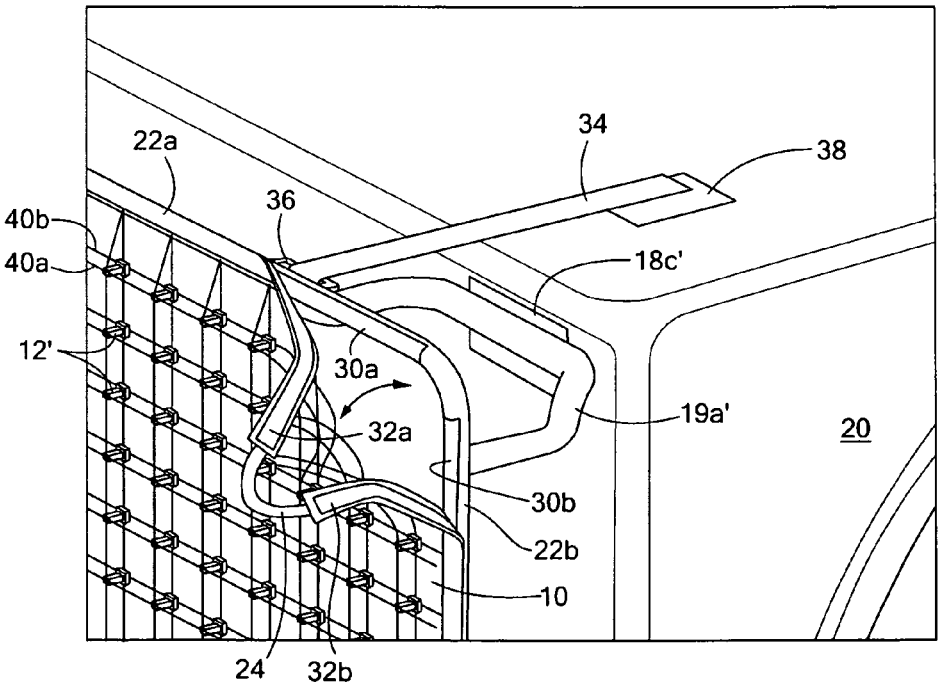
FIG. 3 is a schematic partial side view showing a shield subsystem in accordance with an example of the subject invention now installed on a portion of a vehicle.

FIG. 3 shows frame members 22*a* and 22*b* including hook type fastener strips 30*a* and 30*b*, respectively, and net periphery 24 including loop type fastener strips 32*a* and 32*b*. Mounting bracket 18*c*' is attached to rearwardly extending frame member 19*a*' and includes a rearward face with loop type fasteners. FIG. 3 also shows optional strap 34 extending from ear 36 on frame member 22*a* to attachment 38 on vehicle 20 which may also be secured to vehicle 20 using hook and loop fasteners. Additional straps may also be included. FIG. 3 also shows first (outer) net 40*a* and second (inner) net 40*b* with their nodes interconnected via rods 12'.

As shown in FIG. 4, rod 12' includes base portion 50 and post portion 52 extending from base portion 50. Post 52 includes castellations 54*a*-54*d* for the chord lines 56*a* and 56*b* of net 40*a* defining node 58. Similarly, base 50 includes castellations (e.g, castellations 60*a* and 60*b*) for lines 62*a* and 62*b* of net 40*b* also defining a node (not shown). The lines of the nets may be glued or otherwise secured in the castellations.

FIG. 5 shows a single net design where net lines 66*a* and 66*b* defining node 68 are secured between post portions 68 frictionally received in cavity 70 of base portion 72 of rod 12". The preferred rod is made of steel, has a one inch post, and weighs between 15 and 30 grams.

Figure 6A:
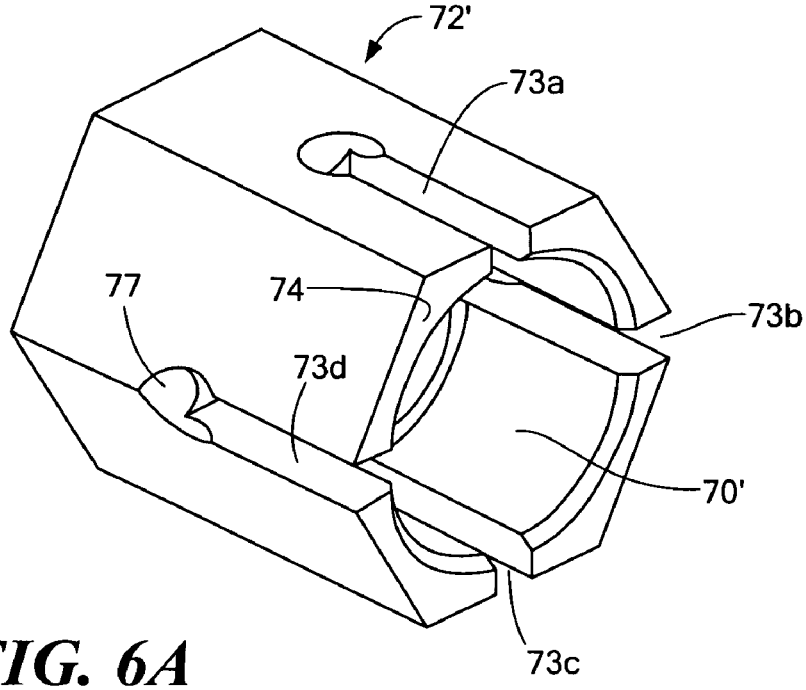
FIGS. 6A-6B are schematic three-dimensional bottom and top views, respectively, of another hard point design in accordance with an example of the subject invention.
Figure 6B:
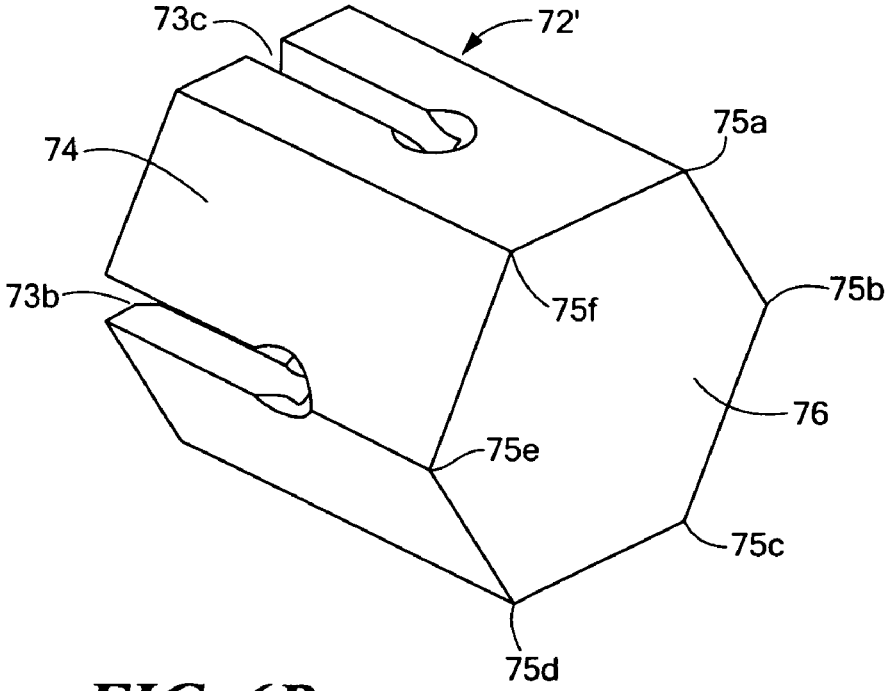
Figure 7:
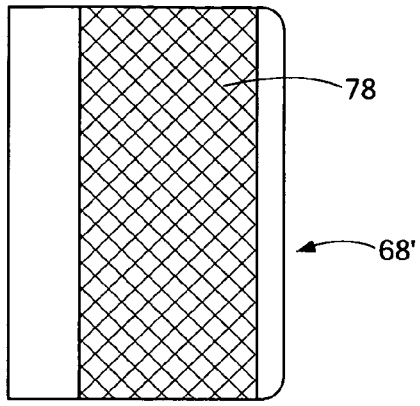
FIG. 7 is a schematic front plan view of a plug for the hard point shown in FIGS. 6A-6B.

FIGS. 6A-6B show base portion 72' with cavity 70' receiving post or plug 68', FIG. 7 therein in a friction fit manner. In this preferred design, the net cords are received through slots 73*a*-*d* in wall 74 of hard point 72'. The slots, as shown for slot 73*a*, terminate in rounded portion 77 preventing wear of the net chords. Wall 74 in this embodiment defines a six-sided structure with six sharp corners 75*a*-75*f* which dig into the skin of an RPG ogive. Top surface 76 may be flat as shown or concave. In one specific design, the hard point and the plug were made of steel, hard point 72' was 0.625 inches from one edge to an opposite edge, and 0.72 inches tall. Cavity 70' was 0.499 inches in diameter and 0.34 inches deep. Thirty gram plug 68', FIG. 7 was 0.34 inches tall, 0.500 inches in diameter, and includes knurling as shown at 78 on the surface thereof.

Manufacturing of a net with hard points in accordance with the subject invention is thus simplified. A net node is placed in cavity 70', FIG. 6A with the net chords exciting through slots 73*a*-73*d* and plug 68', FIG. 7 is then driven in to cavity 70', FIG. 6A to lock the node of the net in the hard point.

There are trade offs in the design of the hard points and also the net. The aspect ratio of the hard points, their size, center of gravity, mass, and the like all play an important role. Hard points which are too large, for example, and a net mesh size which is too small results in too much surface area to be stricken by an RPG, possibly detonating the RPG. Hard points which are too small may not sufficiently damage the RPG ogive and dud the RPG. Steel is a good material choice for the hard points because steel is less expensive. Tungsten, on the other hand, may be used because it is heavier and denser, but tungsten is more expensive. Other materials are possible. The hard points may weigh between 10 and 40 grams and be ½ inch to ¾ inches across and between 0.5 inches and 1 inch tall.

It is preferred that the net node is placed at the center of gravity at the hard point. The length of the hard point is preferably chosen so that when an RPG strikes the net, the hard point tumbles 90 degrees and digs into the RPG ogive. The moment of inertia of the hard point is designed accordingly. In still other designs, the hard point may have more or less than six sides. The hard points may weigh between 10 to 40 grams although in testing 20 to 30 grams was found to be optimal.

The net material may be polyester which provides resistance to stretching, ultraviolet radiation resistance, and durability in the field. Kevlar may also be used. A knotted net is preferred. The chord diameter may be 1.7 to 1.9 mm. The typical net mesh size may be 176 mm (e.g., a square opening 88 mm by 88 mm) for a PG-7V RPG and 122 mm for a PG-7 VM model RPG. But, depending on the design, the net mesh size may range from between 110 and 180 mm.

The preferred spacing or standoff from the net to the vehicle is between 4 and 24 inches but may be between 4 and 60 centimeters. Larger standoffs may extend the footprint of the vehicle and thus be undesirable. Too close a spacing may not insure closing of the electrical circuitry of the RPG ogive by the hard points. The frame and mounting brackets are designed to result in the desired spacing.

It is desirable that the net material and mesh size be chosen and the net designed such that an RPG ogive, upon striking a net chord, does not detonate. RPGs are designed to detonate at a certain impact force. Preferably, the breaking strength of the net chord material is around 240 lbs so that an RPG, upon striking a net chord or chords, does not detonate. The net is thus designed to be compliant enough so that it does not cause detonation of the RPG. Instead, the hard points dig into the RPG ogive and dud the RPG before it strikes the vehicle or structure.

This design is in sharp contrast to a much more rigid chain link fence style shield which causes detonation of the RPG if the RPG strikes a wire of the fence. The overall result of the subject invention is a design with more available surface area where duding occurs as opposed to detonation.

FIG. 6 shows shields 80*a*-80*f* and the like in accordance with the subject invention protecting all of the exposed surfaces of vehicle 20. FIG. 7 shows shields 82*a*-82*d* in accordance with the subject invention protecting the driver's side of vehicle 20.

Figure 8:
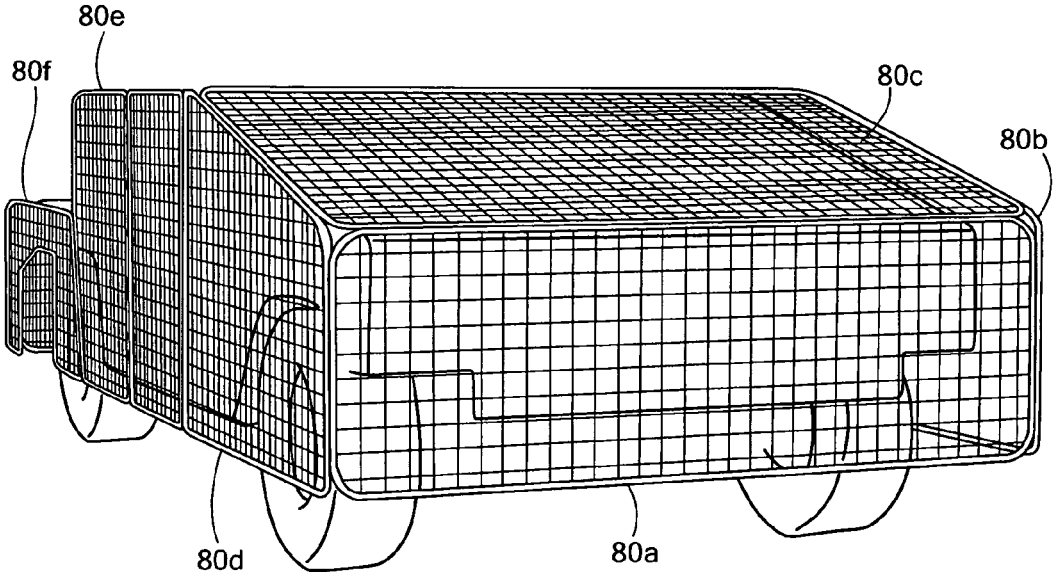
FIG. 8 is a schematic three-dimensional front view showing a number of net shields removeably attached to a military vehicle in accordance with the subject invention.

When an RPG nose or ogive 90, FIG. 8 strikes a shield, the rods or hard points at the nodes of the net(s) angle inwardly toward nose 90 and tear into the skin thereof as shown at 92*a* and 92*b*. If the net and/or frame is destroyed, another shield is easily installed.

Figure 9:
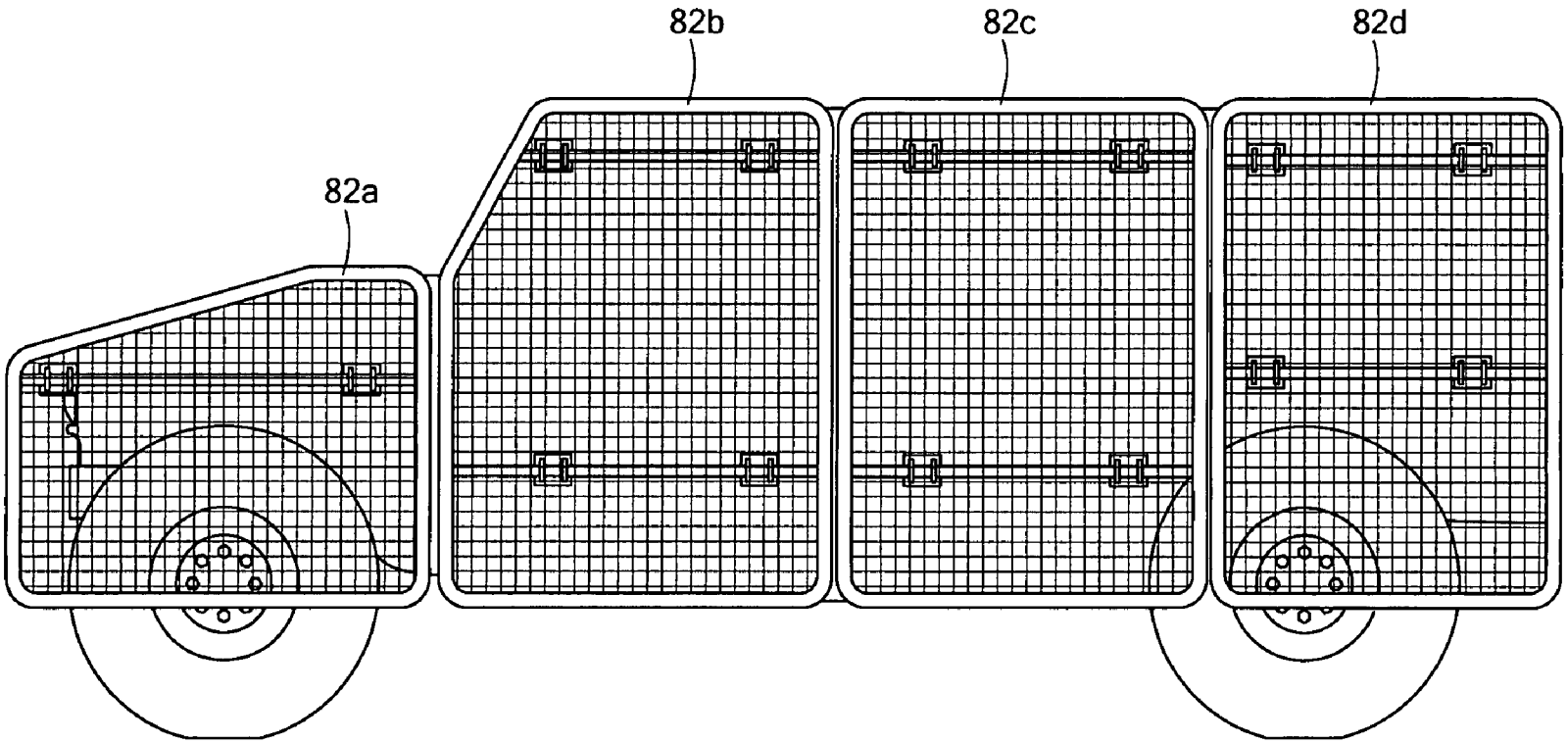
FIG. 9 is a schematic three-dimensional side view showing a number of net shields attached to the side of a military vehicle.
Figure 11:
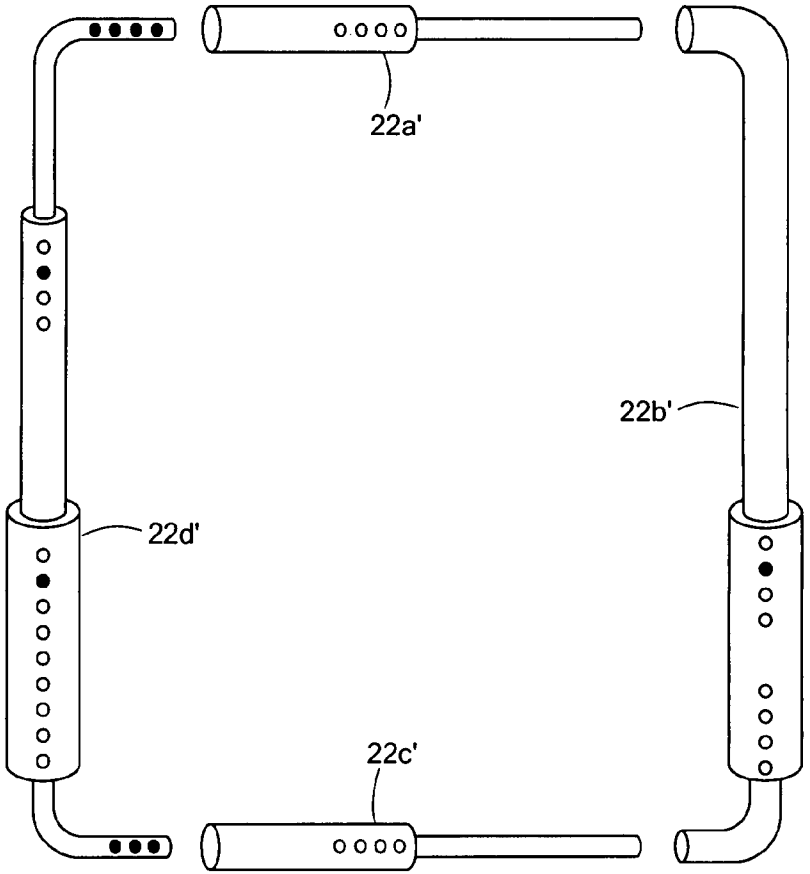
FIG. 11 is a schematic three-dimensional exploded front view showing telescoping frame members in accordance with the subject invention.
Figure 10:
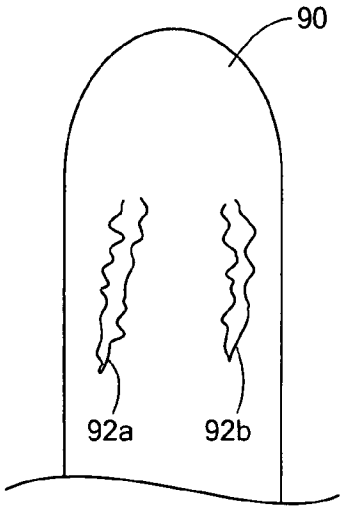
FIG. 10 is a highly schematic three-dimensional top view showing a RPG nose duded by the shield subsystem in accordance with the subject invention.

FIG. 9 shows how frame members 22*a*' can comprise adjustable length telescoping sections for ease of assembly and for tailoring a particular frame to the vehicle or structured portion to be protected.

In one embodiment, the frame members are made of light weight aluminum. One complete shield with the net attached weighed 1.8 lbs. The shield is thus lightweight and easy to assemble, attach, and remove. If a given shield is damaged, it can be easily replaced in the field. The rods connected to the net cell nodes are configured to angle inwardly when an RPG strikes the net. This action defeats the RPG by duding it since the electronics associated with the explosives of the RPG are shorted as the rods impact or tear through the outer skin of the RPG ogive.

The result, in one preferred embodiment is an inexpensive and light weight shielding system which is easy to install and remove. The shields can be adapted to a variety of platforms and provide an effective way to prevent the occupants of the vehicle or the structure from injury or death resulting from RPGs or other ordinances. When used in connection with vehicles, the shield of the subject invention exhibits a low vehicle signature since it extends only a few inches from the vehicle.

The system of the subject invention is expected to meet or exceed the effectiveness of bar/slat armor and yet the flexible net style shield of the subject invention is much lighter, lower in cost, and easier to install and remove. The system of the subject invention is also expected to meet or exceed the effectiveness of chain link fence style shields and yet the net/hard point design of the subject invention is lower in cost, lighter and easier to install and remove.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A method of protecting a vehicle or structure, the method comprising:

choosing a flexible compliant net including strands designed to break if struck by a projectile;

attaching an array of hard points on the net, the hard points designed and attached to the net in such a manner that the hard points tumble and angle inwardly digging into an ogive of a projectile striking the net;

attaching the net to a frame;

attaching the frame to a vehicle or structure supporting the net and hard points; and spacing the frame at a predetermined distance from the vehicle or structure.

2. The method of claim 1 in which attaching the net to the frame includes using hook and loop fasteners.

3. The method of claim 1 in which attaching the frame to the vehicle or structure includes using hook and loop fasteners.

4. The method of claim 1 in which the net mesh size is between 110 mm and 180 mm.

5. The method of claim 1 in which the hard points weigh between 10 to 40 grams, are between ½ inch to ¾ inches across, between ½ inch to 1 inch tall, and are multi-sided.

6. The method of claim 1 in which the frame is designed to space the net between 4 and 24 inches from the vehicle or structure.

* * * * *